United States Patent [19]

Drum

[11] 4,344,583

[45] Aug. 17, 1982

[54] TOILET TISSUE HOLDER

[76] Inventor: Harry R. Drum, Box 430, Ruthven, Iowa 51358

[21] Appl. No.: 177,195

[22] Filed: Aug. 11, 1980

[51] Int. Cl.[3] ..... B65H 19/00

[52] U.S. Cl. ..... 242/55.2; 242/129.6

[58] Field of Search ..... 242/55.2, 55.3, 55.53, 242/129.6, 129.62; 225/46

[56] References Cited

U.S. PATENT DOCUMENTS

| | | | |
|---|---|---|---|
| 960,363 | 6/1910 | Marshall | 242/55.2 |
| 2,619,297 | 11/1952 | Sharrer | 242/55.3 |
| 2,658,690 | 11/1953 | Hill | 242/55.2 |
| 3,430,877 | 3/1969 | Bevlet | 242/55.2 |
| 3,586,252 | 6/1971 | Sutton | 242/55.3 |

*Primary Examiner*—Leonard D. Christian

*Attorney, Agent, or Firm*—Zarley, McKee, Thomte, Voorhees & Sease

[57] ABSTRACT

The wall bracket includes two identical metal L-shaped members, having vertically disposed elongated slots in the legs extending away from the wall which receive a metal plate bar which has an L-shaped end and an opposite end having an aperture to receive a lock.

2 Claims, 7 Drawing Figures

TOILET TISSUE HOLDER

BACKGROUND OF THE INVENTION

Outdoor recreational areas such as parks have a particular problem in their restrooms with vandalism. Toilet tissue holders will oftentimes be torn from the walls. Heavy usage during the weekends also gives rise for the need of a multiple roll tissue holder. Accordingly, a toilet tissue holder is needed that will be indestructible and will hold a sufficient number of rolls of toilet tissue to serve the needs of the users over an extended period of time. The holder should also be easily manufactured, and involve a minimum number of parts.

Prior art holders of Sharrer, U.S. Pat. No. 2,619,297, Nov. 25, 1952, and Fairchild, U.S. Pat. No. 1,917,641, July 11, 1933, are unsatisfactory since they are lightweight, easily destroyed and involve comparatively complicated structures which are difficult to manufacture and thus expensive.

SUMMARY OF THE INVENTION

A toilel tissue holder involves three component parts. Two are identical and thus may be easily mass produced. The first two are L-shaped oppositely disposed wall brackets which have vertically arranged elongated slots in the outer ends of the legs extending away from the wall which receive the tissue bar which is limited against longitudinal movement by an L-shaped end which abuts one of the L-shaped brackets and a lock which is adapted to engage an aperture in the other end and which would abut the other L-shaped bracket. When the bar is to be loaded, it is merely necessary to remove the lock and slide the bar within the slots exposing the one end, whereby old rolls may be removed and new rolls inserted thereon. Any number of rolls may be provided on the bar, depending on the bar's length. The holder is preferably bolted to the wall through the brackets and thus is essentially indestructible.

DESCRIPTION OF THE PREFERRED EMBODIMENT

Figure 1:
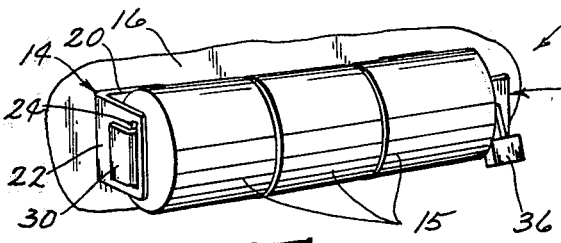
FIG. 1 is a perspective view of the toilet tissue holder of this invention.
Figure 2:
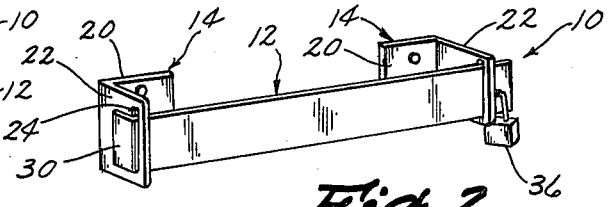
FIG. 2 is a view similar to FIG. 1, showing the holder without any tissue.
Figure 3:
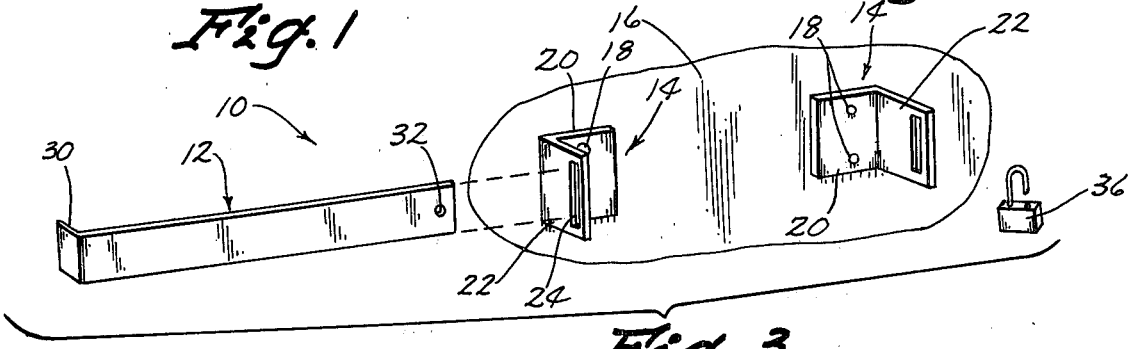
FIG. 3 is a exploded perspective view of the toilet tissue holder.
Figure 4:
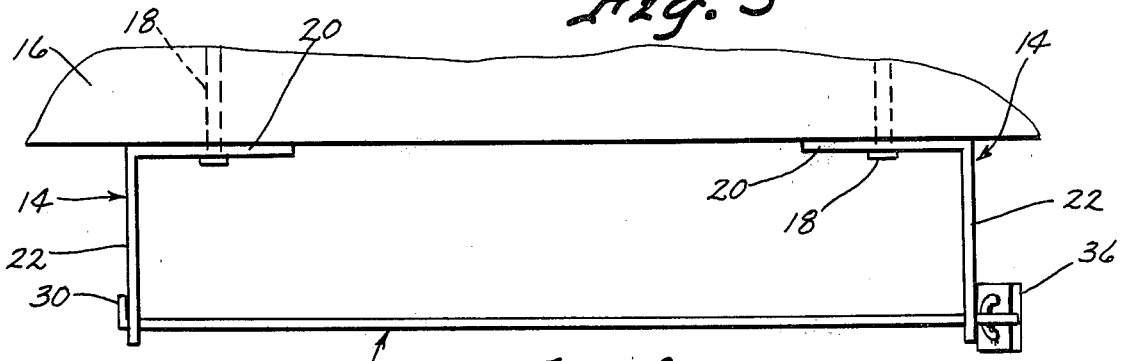
FIG. 4 is a top plan view thereof.
Figure 5:
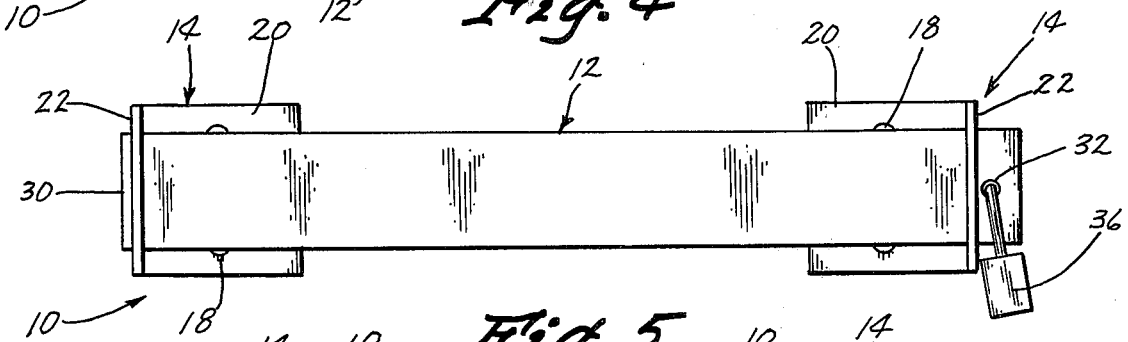
FIG. 5 is a front elevational view.
Figure 6:
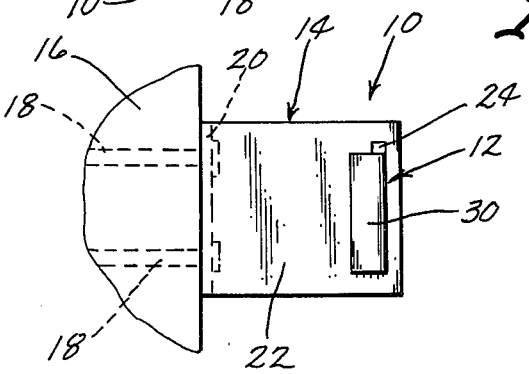
FIG. 6 is an end elevational view from the left hand side of FIG. 5.
Figure 7:
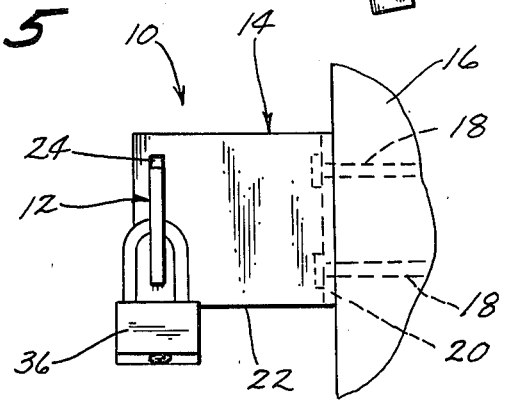
FIG. 7 is a right hand elevational view taken from the right hand in FIG. 5.

The toilet tissue holder of this invention is referred to generally in FIG. 1 by the reference numeral 10, and is seen to include essentially three component parts, two of which are identical. The first is an elongated plate metal bar 12 for holding toilet tissue rolls 15 on L-shaped wall brackets 14 secured to a wall 16 by bolts 18.

The L-shaped brackets have a first leg 20 that is bolted to the wall by bolts 18 and a second leg 22 which has an elongated vertically disposed slot 24.

The toilet tissue bar 12 has an L-shaped end portion 30 at one end and an aperture 32 at the opposite end. The L-shaped portion 30 engages the adjacent leg 22 of the left hand bracket 14 to limit movement of the bar 12 towards the right, while a lock 36 in the aperture 32 will limit movement of the bar 12 toward the left.

The metal plate material used for the brackets 14 and the tissue bar 12 is of sufficiently heavy metal that they cannot be damaged through the use of a person's hands, but would require special tools. With the mounting bolts extending all the way through the wall, the tissue holder becomes substantially indestructible. Accordingly, the tissue holders of the present design are, for all practical purposes, immune to typical acts of vandalism that occur in outdoor recreational restroom facilities.

The simplicity of construction involving only two component parts, makes it possible to mass produce the identical L-shaped wall mounted members 14 and then different length tissue bars 12 can be manufactured and made available to meet the demand for different sized tissue holders for holding one to three and more rolls of tissue.

What is claimed is:

1. A toilet tissue holder comprising, a pair of substantially identical oppositely disposed spaced apart rigid L-shaped metal plate members and each having one leg adapted to be secured to a wall or other supporting structure in either a right-handed or lefthanded position, with the other leg extending perpendicularly thereto, said other leg having an elongated slot adjacent its outer end, and a rigid metal plate bar being L-shaped at one end extending through said slots in the other legs of said L-shaped metal plate members with said L-shaped one end engaging the adjacent other leg to limit movement in one direction through said slot, and the opposite end of said bar having an aperture for receiving a lock to limit movement of said bar in the opposite direction, when said holder is in use and when said holder is being refilled, and said lock is removed said bar may be moved in said slots in the opposite direction to disengage said opposite end of said bar from the slot in the adjacent other leg of said L-shaped plate member.

2. The structure of claim 1 wherein said plate bar is disposed in a vertical plane and said slots in said other legs are vertically disposed.

* * * * *